US012490833B2

(12) United States Patent
Chen

(10) Patent No.: US 12,490,833 B2
(45) Date of Patent: Dec. 9, 2025

(54) CHAIR SEAT AND CLAMPING DEVICE

(71) Applicant: ATEC INTERNATIONAL TEAM CO., LTD., Taoyuan (TW)

(72) Inventor: Te-Chun Chen, Taoyuan (TW)

(73) Assignee: ATEC INTERNATIONAL TEAM CO., LTD., Taoyuan (TW)

( * ) Notice: Subject to any disclaimer, the term of this patent is extended or adjusted under 35 U.S.C. 154(b) by 247 days.

(21) Appl. No.: 18/211,724

(22) Filed: Jun. 20, 2023

(65) Prior Publication Data

US 2024/0341484 A1 Oct. 17, 2024

(30) Foreign Application Priority Data

Apr. 13, 2023 (CN) ..... 202310390436.5

(51) Int. Cl.
*A47C 7/54* (2006.01)

(52) U.S. Cl.
CPC ..... *A47C 7/541* (2018.08); *A47C 7/546* (2013.01)

(58) Field of Classification Search
CPC ..... A47C 7/546
See application file for complete search history.

(56) References Cited

U.S. PATENT DOCUMENTS 4,536,031 A * 8/1985 Latone ..... A47C 7/40 297/383
5,338,133 A * 8/1994 Tornero ..... A47C 1/03 297/411.37 X
5,368,364 A * 11/1994 Kanai ..... A47C 7/546 297/411.27 X
5,419,617 A * 5/1995 Schultz ..... A47C 7/546 297/411.27 X
5,462,338 A * 10/1995 Baumann ..... A47C 1/03 297/411.37 X (Continued)

FOREIGN PATENT DOCUMENTS

CN 201675443 U 12/2010
JP P2000-279263 A 10/2000

(Continued)

*Primary Examiner* — Rodney B White
(74) *Attorney, Agent, or Firm* — LANWAY IPR SERVICES; Chun-Ming Shih

(57) ABSTRACT

A chair seat is provided for combining with two armrests. Each armrest includes a crossbar. The chair seat includes a base and two clamping devices. The base includes at least one armrest slot and two mounting holes. The armrest slot is adapted for inserting the crossbar, and the mounting hole is in communication with the armrest slot. The two clamping devices are separately installed within the two mounting holes. Each clamping device includes a mounting base, a clamping element, an operating element, and a transmission element. The mounting base is affixed within the mounting hole and features an installation slot on one side. The clamping element is installed within the installation slot, facing the crossbar. The operating element is situated on the opposite side of the installation slot relative to the mounting base. The transmission element connects the clamping element and the operating element. The operating element is suitable for driving the transmission element, which in turn moves the clamping element toward the crossbar, thereby securing it.

12 Claims, 18 Drawing Sheets

(56) References Cited

U.S. PATENT DOCUMENTS 5,615,926 A * 4/1997 Kanai ..... A47C 7/546 297/411.27
5,839,784 A * 11/1998 Breen ..... A47C 1/0307 297/411.37 X
5,944,387 A * 8/1999 Stumpf ..... A47C 1/03 297/411.37
6,409,266 B1 * 6/2002 Chen ..... A47C 1/03 297/411.37 X
6,572,195 B1 * 6/2003 Lee ..... A47C 1/0307 297/411.37
7,806,481 B2 * 10/2010 Eberlein ..... A47C 1/03 297/411.37
8,104,838 B2 * 1/2012 Tsai ..... A47C 1/0307 297/411.37 X
8,449,035 B2 * 5/2013 Breitkreuz ..... A47C 7/42 297/411.37 X
8,459,746 B2 * 6/2013 Lai ..... A47C 1/0307 297/411.27
9,578,971 B2 * 2/2017 Su ..... A47C 1/03
9,795,220 B1 * 10/2017 Chen ..... A47C 1/03
10,772,434 B2 * 9/2020 Susie ..... A47C 7/546
11,478,085 B2 * 10/2022 Sollie ..... A47C 7/541
11,622,631 B1 * 4/2023 Berkowitz ..... A47C 7/004 297/452.41
11,672,347 B1 * 6/2023 Wu ..... A47C 7/42 297/440.15
11,898,584 B2 * 2/2024 Slach ..... F16B 12/2009
11,950,709 B2 * 4/2024 Bock ..... A47C 4/028
2010/0123346 A1 * 5/2010 Lin ..... A47C 1/03 297/411.37
2017/0027369 A1 2/2017 Zimmerman
2021/0345786 A1 11/2021 Peng

FOREIGN PATENT DOCUMENTS

JP U3158321 U 3/2010
TW I576072 B 4/2017
TW I647134 B 1/2019

* cited by examiner

CHAIR SEAT AND CLAMPING DEVICE

FIELD OF THE DISCLOSURE

The present disclosure relates to office chairs, specifically, a chair seat having a clamping element and an operating element.

BACKGROUND OF THE INVENTION

Nowadays, with the increasing demands of work and living environments, people's requirements for office chairs are becoming higher and higher. In addition to the flexibility, comfort, and aesthetics of the chair, it also needs to have adjustable functions to adapt to different user heights, body types, and usage methods. The design of adjustable armrest office chairs is to meet these needs.

However, the disadvantages of this design are also obvious. First, the assembly is relatively difficult, and it is hard for users without specific technical skills to complete it on their own. Second, this design requires more components, which not only increases the difficulty of assembly but also raises the production cost. Lastly, due to the challenging assembly, it is not suitable for the DIY furniture market.

Therefore, how to solve these problems and make the adjustable armrest office chair have advantages such as high efficiency, low cost, and easy assembly is an issue worth considering for those skilled in the art.

SUMMARY OF THE INVENTION

The objective of the present disclosure is to provide a chair seat that has the advantages of high efficiency, low cost, and easy assembly.

The chair seat of the invention is adapted for combining with two armrests, each of which includes a crossbar, and the chair seat includes a base and two clamping devices. The base includes at least one armrest slot and two mounting holes. The armrest slot is suitable for inserting the crossbar, and the mounting hole is in communication with the armrest slot.

Furthermore, the two clamping devices are respectively installed in the two mounting holes. Each clamping device includes a mounting base, a clamping element, an operating element, and a transmission element. The mounting base is installed and fixed in the mounting hole, and one side of the mounting base is also equipped with a mounting slot. The clamping element is installed in the mounting slot and faces the crossbar. In addition, the operating element is located on the other side of the mounting base relative to the mounting slot. The transmission element is connected between the clamping element and the operating element. The operating element is suitable for driving the transmission element, which in turn drives the clamping element to move towards the crossbar and clamp it.

In the aforementioned chair seat, the operating element is a rotating handle, and the rotating handle has a central hole. The transmission element includes a mounting shaft and a pressing member. One end of the mounting shaft is installed in the central hole. The pressing member is installed on the other end of the mounting shaft and located in the mounting slot. the pressing member has a first toothed element on a side near the mounting slot and presses against the clamping element. A second toothed element is provided at the bottom of the mounting slot. The second toothed element is engaged with the first toothed element. When the rotating handle is rotated in one direction, the mounting shaft causes the first and second toothed elements to move relatively. The pressing member drives the clamping element to move towards the crossbar and clamp it.

In the aforementioned chair seat, the pressing member further comprises two first limiting members. The two first limiting members is respectively located on both sides of the first toothed element and is arranged in a parallel and symmetrical manner. The mounting slot further comprises two second limiting members, the two second limiting members is respectively located on both sides of the second toothed element and is arranged in a parallel and symmetrical manner.

In the aforementioned chair seat, a sliding groove is provided on the crossbar of the armrest, and the mounting base further comprises an anti-detachment member. The anti-detachment member is adapted to interfere with one edge of the sliding groove to prevent the crossbar from being pulled out of the armrest slot.

In the aforementioned chair seat, an anti-detachment member is provided on the crossbar of the armrest. The mounting base further comprises a retaining slot. The anti-detachment member is adapted to interfere with one edge of the retaining slot to prevent the crossbar from being pulled out of the armrest slot.

In the aforementioned chair seat, the chair seat further includes two anti-slip plates. An embedding hole is provided in a vicinity of each mounting hole of the base. The anti-slip plate is installed in the embedding hole. A first engaging edge and a second engaging edge are respectively provided on opposite sides of the mounting base. The mounting base is supported on the base by the first engaging edge and the second engaging edge, and the first engaging edge is in contact with the anti-slip plate.

In the aforementioned chair seat, the embedded hole is separated from the mounting hole by a supporting beam. The first engaging edge is supported on the supporting beam. The width of the first engaging edge is greater than the width of the supporting beam. The width of the second engaging edge in interference with the base is less than the width of the anti-slip plate.

In the aforementioned chair seat, the anti-slip plate has an anti-pulling structure, which is engaged with the supporting beam.

Another object of the present disclosure is to provide a clamping device that can be installed on an adjustable armrest chair, which helps the user to assemble the armrest quickly and conveniently on the adjustable armrest chair.

The clamping device suitable for installation on a mounting hole of a base of a chair seat. The clamping device comprises a mounting base, a clamping element, a rotating handle, and a transmission element. The mounting base is installed and fixed in the mounting hole, and one side of the mounting base is further provided with an installation slot. The clamping element is installed in the installation slot. In addition, the rotating handle is disposed on the other side of the mounting base relative to the installation slot and has a central hole. The transmission element comprises a mounting shaft and a pressing member. One end of the mounting shaft is installed in the central hole, while the pressing member is installed at the other end of the mounting shaft and located in the installation slot. The pressing member is provided with a first toothed element near the installation slot and presses against the clamping element. A second toothed element is provided at the bottom of the installation slot and engages with the first toothed element. When the rotating handle is rotated in one direction, the mounting shaft drives the first toothed element to move relative to the second toothed element, thereby causing the pressing member to drive the clamping element to move up and down.

In the aforementioned clamping device, the pressing member further includes two first limiting members. The two first limiting members are respectively located on both sides of the first toothed element and arranged in a parallel and symmetrical manner. The installation slot further includes two second limiting members. The two second limiting members are respectively located on both sides of the second toothed element and arranged in a parallel and symmetrical manner.

In the aforementioned clamping device, the mounting base further includes an anti-extraction member. The anti-extraction member and the installation slot are located on the same side of the mounting base.

In the aforementioned clamping device, the mounting base further includes a retaining slot, the retaining slot and the installation slot are located on the same side of the mounting base.

Another embodiment of the present invention provides a chair seat suitable for combining with two armrests. Each of the armrests includes a crossbar. The chair seat comprises a base, two clamping devices, and two anti-slip plates. The base includes at least one armrest slot and two mounting holes. the armrest slot is adapted for the crossbar to be inserted. The mounting holes is in communication with the armrest slot. An embedding hole is provided in the vicinity of each mounting hole of the base.

In addition, the two clamping devices are respectively installed in the two mounting holes. Each of the clamping devices includes a mounting base and a clamping element. The mounting base is installed and fixed in the mounting hole. One side of the mounting base is provided with an installation slot. A first engaging edge and a second engaging edge is respectively provided on opposite sides of the mounting base. The clamping element is installed in the installation slot and faces the crossbar. The clamping element is adapted to clamp the crossbar. The anti-slip plate is installed on the other side of the mounting base opposite the installation slot. The anti-slip plate is installed in the embedding holes. Through the first engaging edge and the second engaging edge, the mounting base is supported on the base, and the first engaging edge is in contact with the anti-slip plate.

The invention has the following advantages: it allows users to assemble armrests easily and quickly on both sides of the seat cushion, and reduces the package size, significantly lowering the cost of shipping the chair product.

The foregoing, as well as additional objects, features and advantages of the invention will be more readily apparent from the following detailed description, which proceeds with reference to the accompanying drawings.

BRIEF DESCRIPTION OF THE DRAWINGS

The objects, spirits, and advantages of the preferred embodiments of the present disclosure will be readily understood by the accompanying drawings and detailed descriptions, wherein.

DESCRIPTION OF THE PREFERRED EMBODIMENTS

Figure 1A:
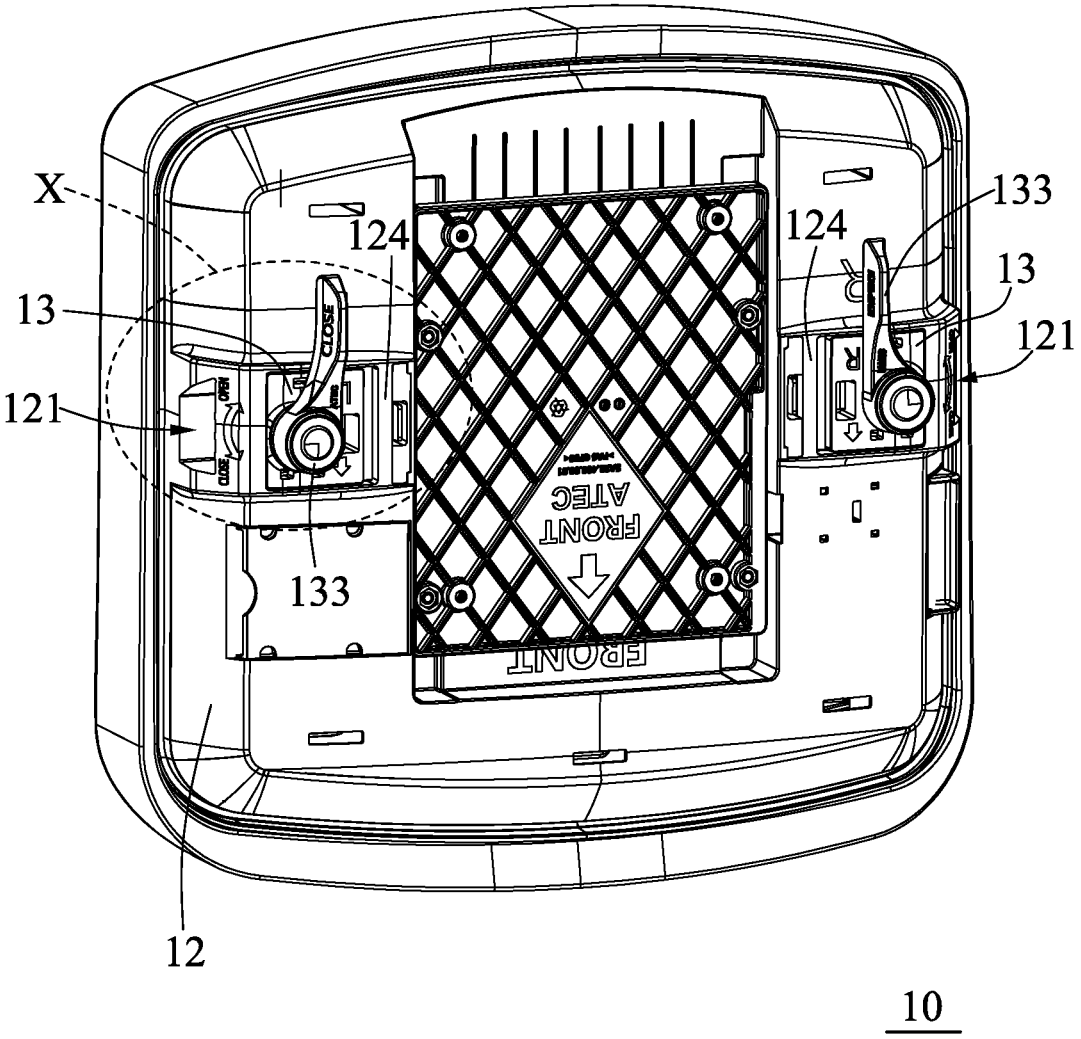
FIG. 1A is a schematic diagram of a chair seat according to the present embodiment.
Figure 1B:
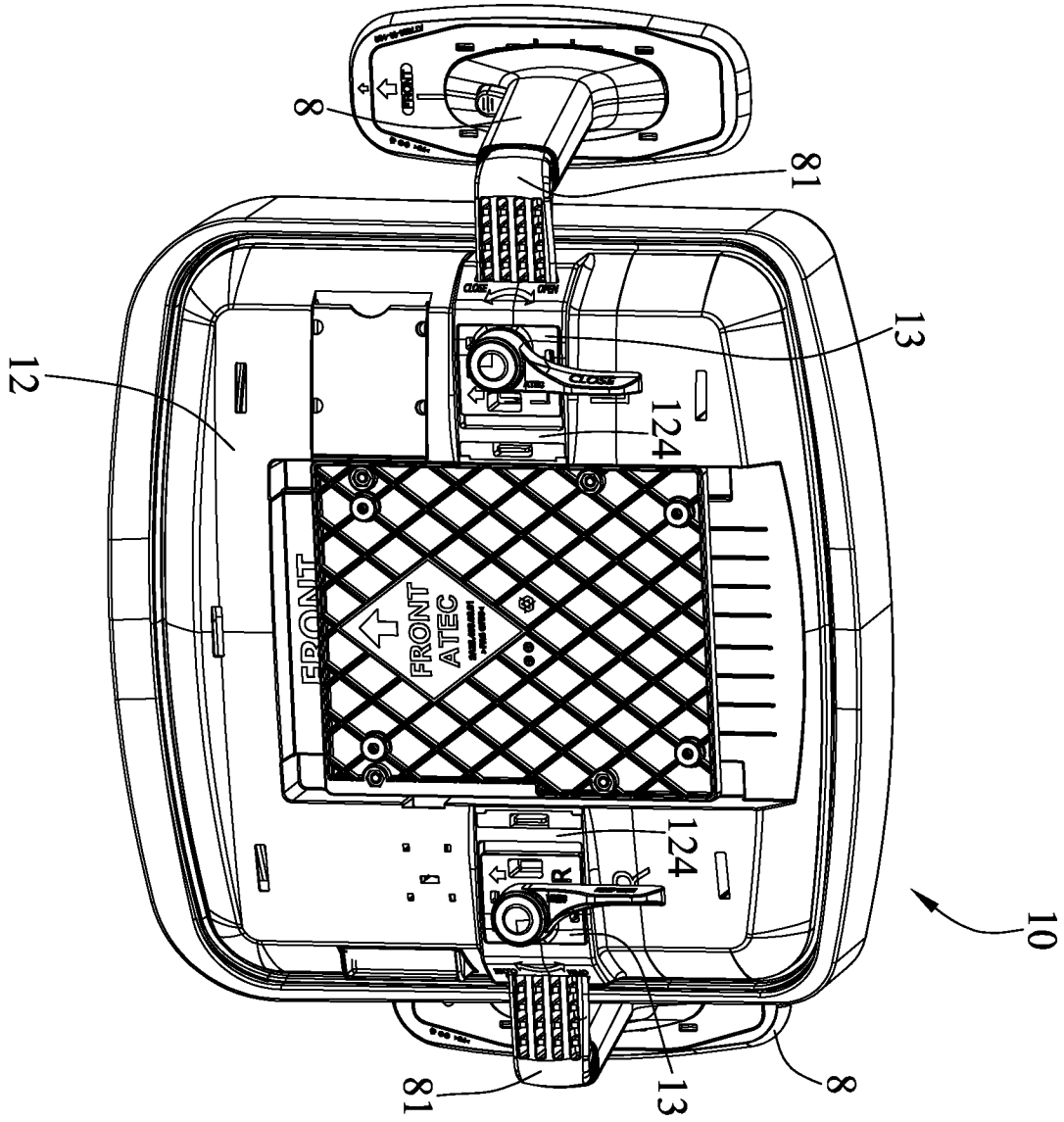
FIG. 1B is a schematic diagram of the chair seat combined with two armrests.
Figure 1C:
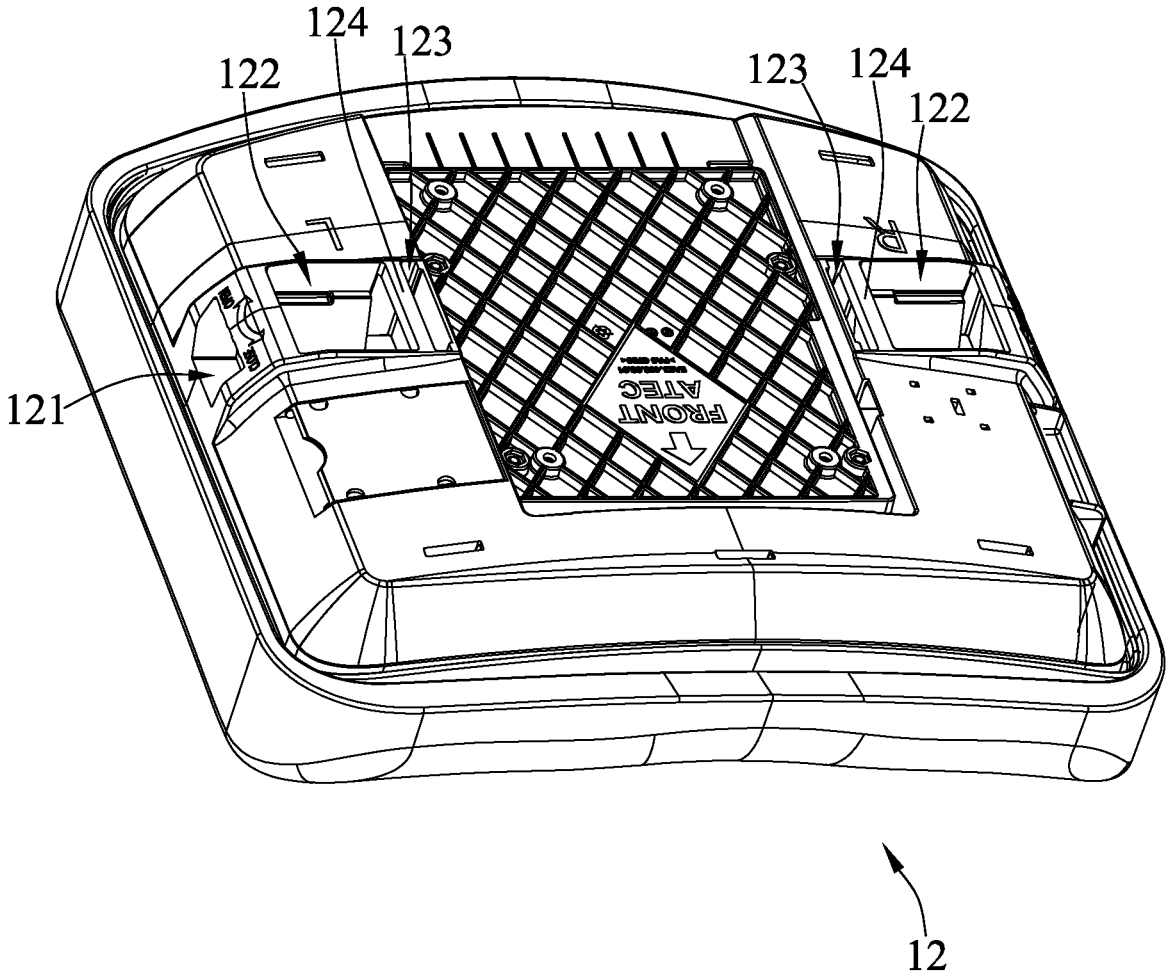
FIG. 1C is a schematic diagram of the mounting hole.

Please refer to FIG. 1A to FIG. 1C. FIG. 1A shows a schematic diagram of the chair seat 10 in the present embodiment, FIG. 1B shows a schematic diagram of the chair seat 10 combined with two armrests 8, and FIG. 1C shows a schematic diagram of the mounting hole 122. The chair seat 10 of the present embodiment includes a base 12 and two clamping devices 13. The base 12 includes two armrest slots 121, two mounting holes 122, two embedding holes 123, and two supporting beams 124. Each mounting hole 122 communicates with one of the armrest slots 121, and each mounting hole 122 is adjacent to a embedding hole 123. Each mounting hole 122 is separated from the adjacent embedding hole 123 by a supporting beam 124.

In the embodiment, the mounting hole 122 is located on the back surface of the base 12. However, in other embodiment, the mounting hole 122 can be located on the side of the base 12.

Figure 2:
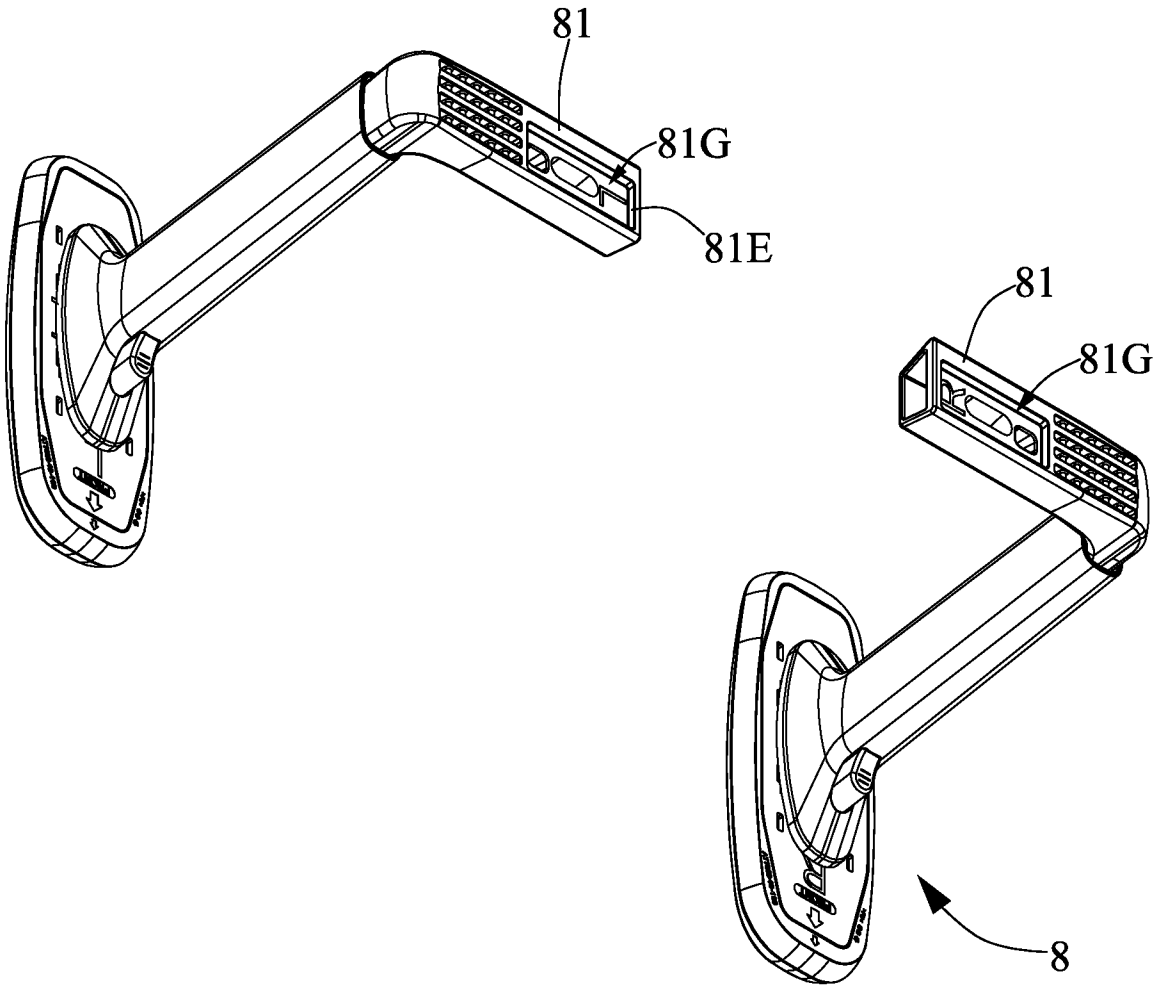
FIG. 2 is a schematic diagram of the armrest.

Please refer to FIG. 1B and FIG. 2. FIG. 2 shows a schematic diagram of the armrest 8. The chair seat 10 is suitable for being combined with two armrests 8, each of which includes a crossbar 81 with a sliding groove 81G. Specifically, one end of the crossbar 81 of the armrest 8 is inserted into the armrest slot 121 of the base 12, and the lateral length of the sliding groove 81G defines the range of movement for the armrest 8. The position of the armrest 8 must be fixed by the clamping device 13, which will be further exemplified in the following paragraphs.

Figure 3A:
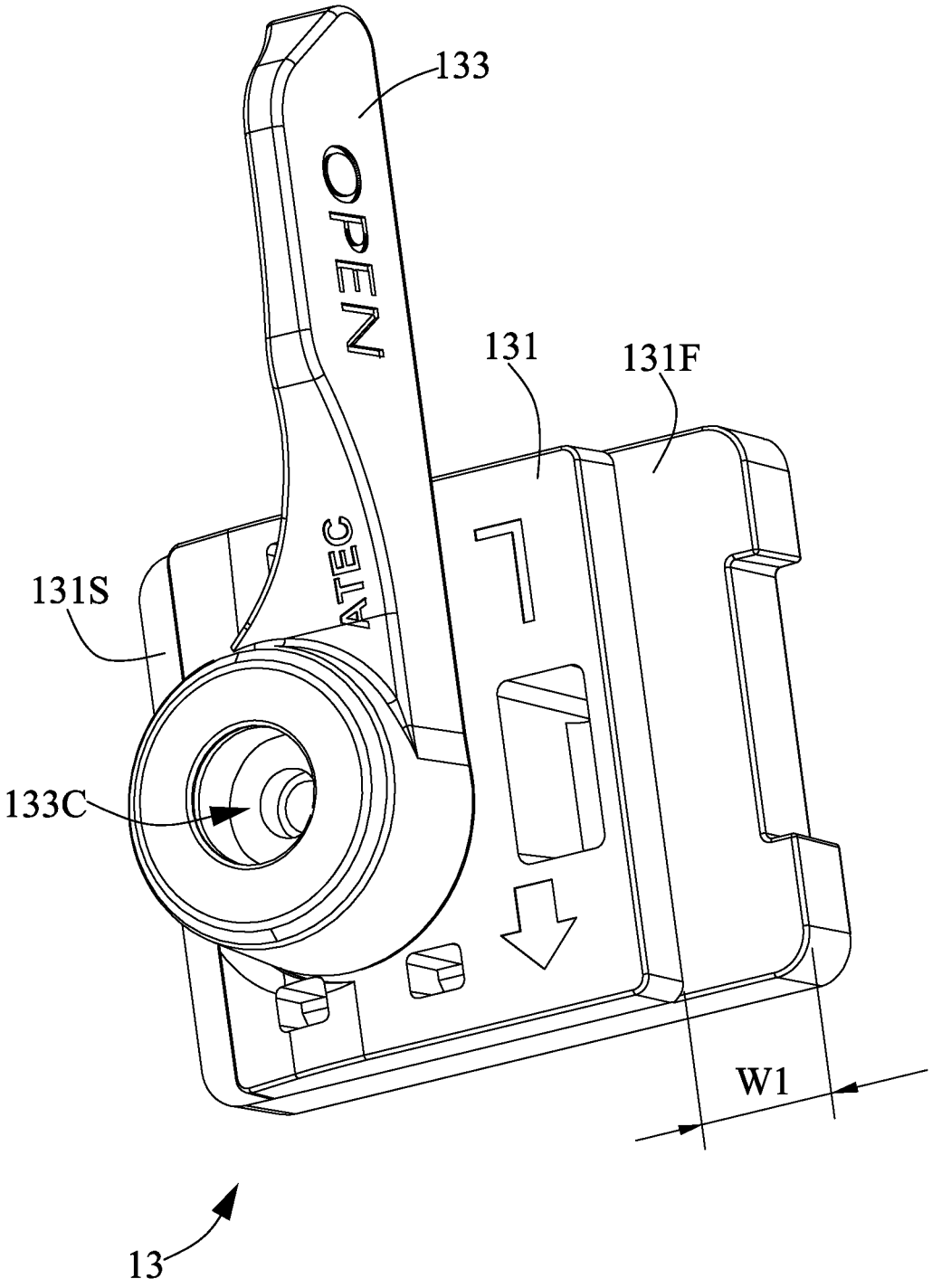
FIGS. 3A and 3B are schematic diagrams of the clamping device.
Figure 3B:
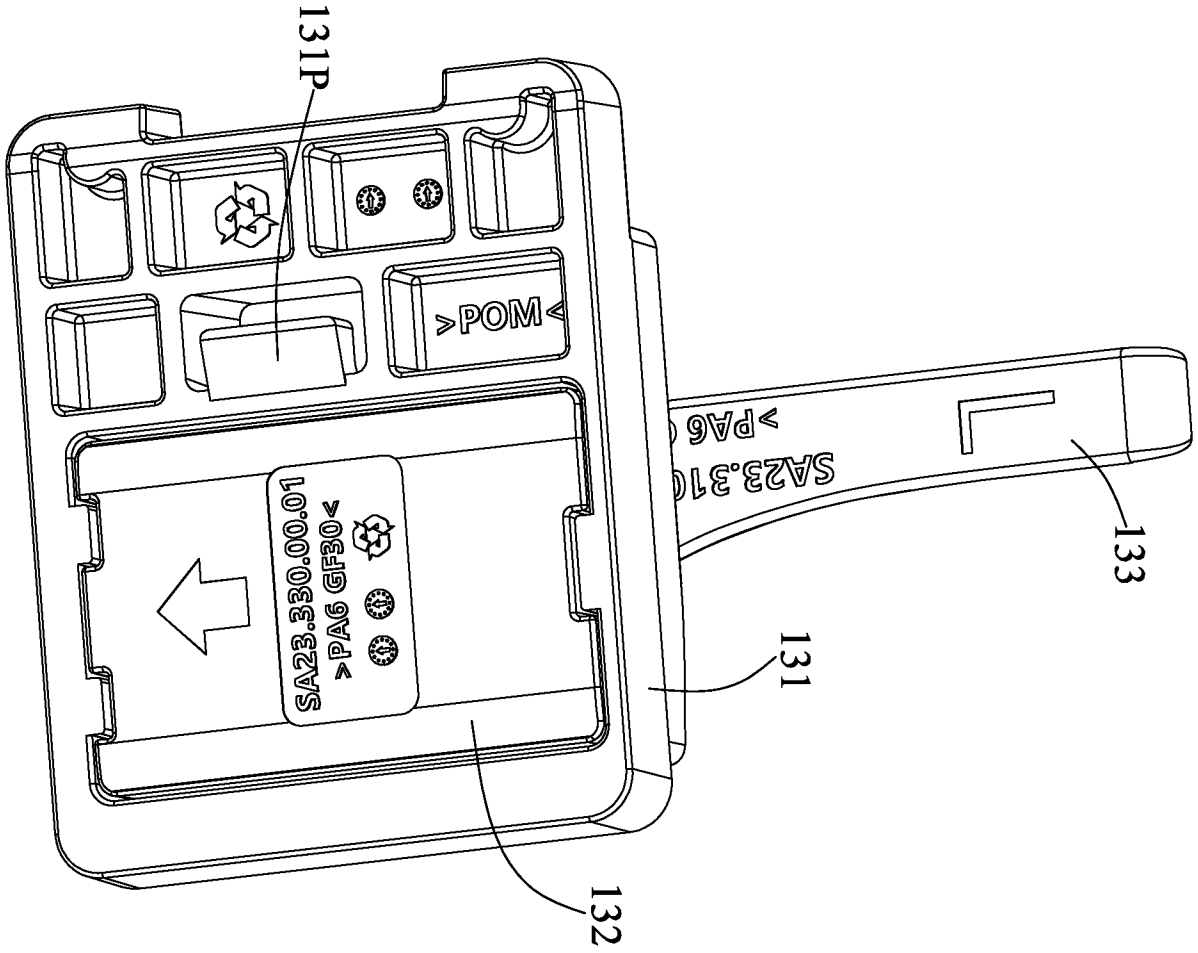
Figure 3C:
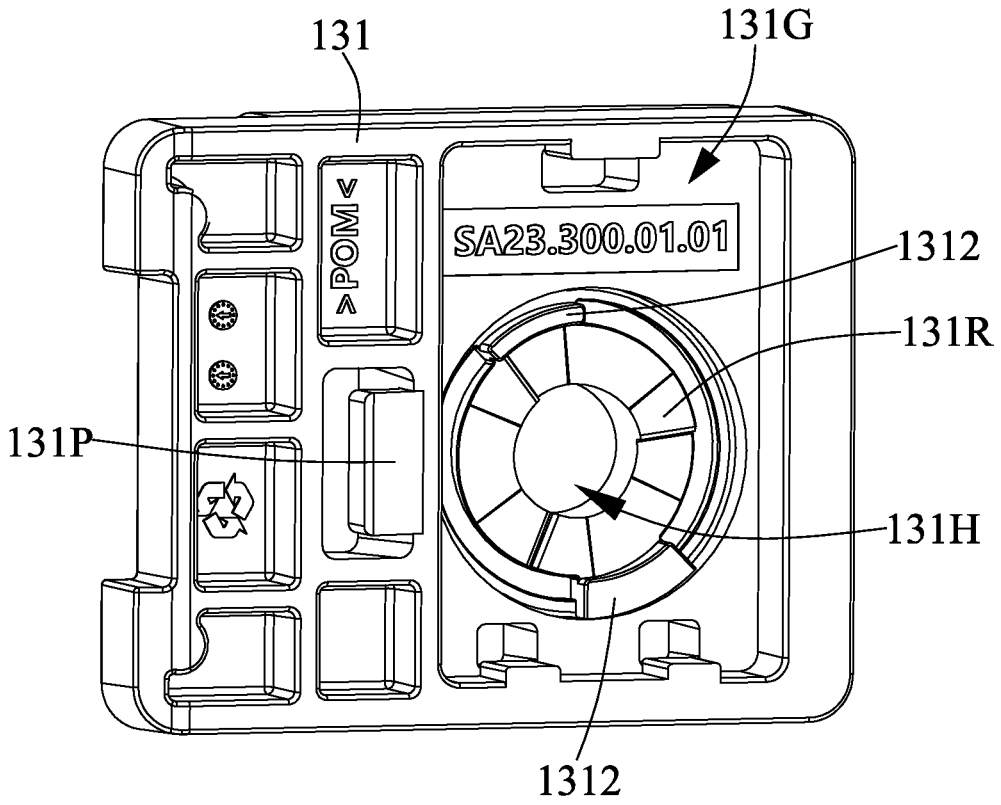
FIG. 3C is a schematic diagram of the mounting slot.
Figure 3D:
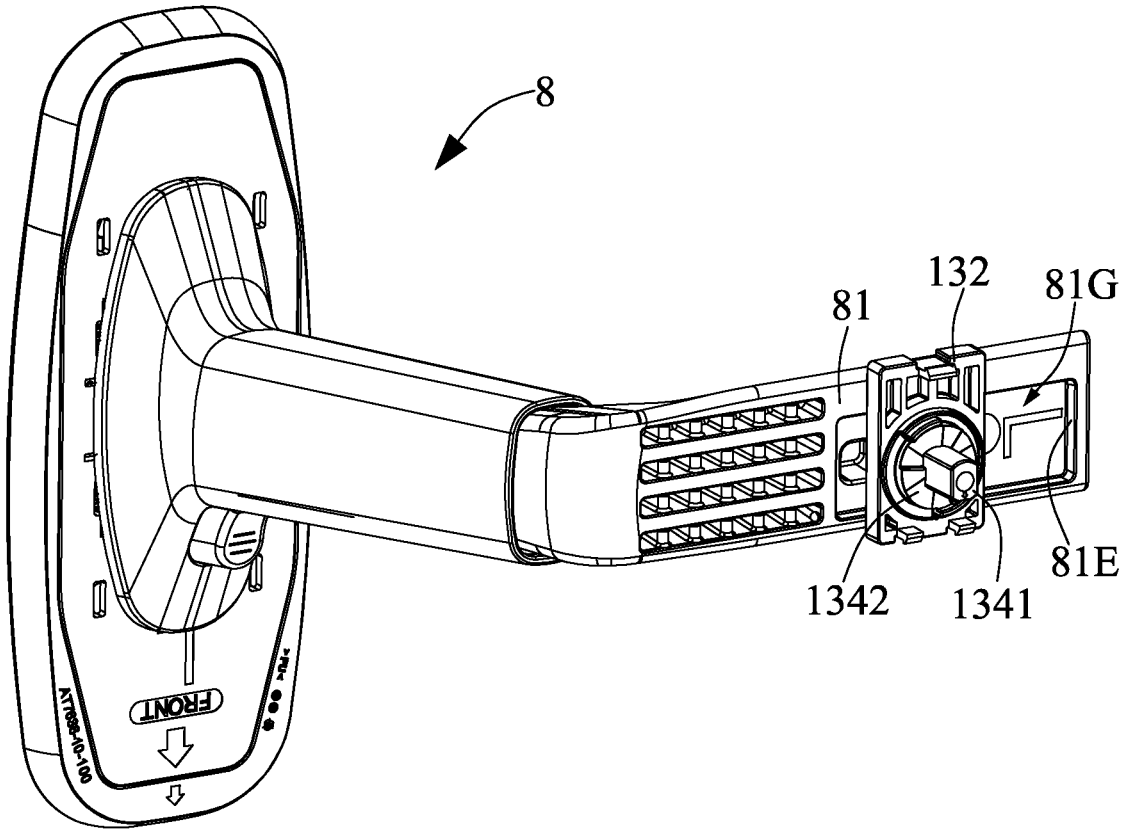
FIG. 3D is a schematic diagram of the clamping element facing the crossbar.

Please refer to FIG. 3A to FIG. 3D. FIG. 3A and FIG. 3B show schematic diagrams of the clamping device 13, FIG. 3C shows a schematic diagram of the mounting slot 131G, and FIG. 3D shows a schematic diagram of the clamping element 132 facing the crossbar 81. The two clamping devices 13 are respectively installed in the two mounting holes 122, and each clamping device 13 includes a mounting base 131, a clamping element 132, an operating element 133, and a transmission element 134 (please refer to FIG. 5). The mounting base 131 is installed and fixed within the mounting hole 122, and one side of the mounting base 131 is provided with a mounting slot 131G and an anti-detachment member 131P. The anti-detachment member 131P is adapted to interfere with one edge 81E of the sliding groove 81G of the crossbar 81, thus preventing the crossbar 81 from being pulled out or falling from the armrest slot 121.

Figure 3E:
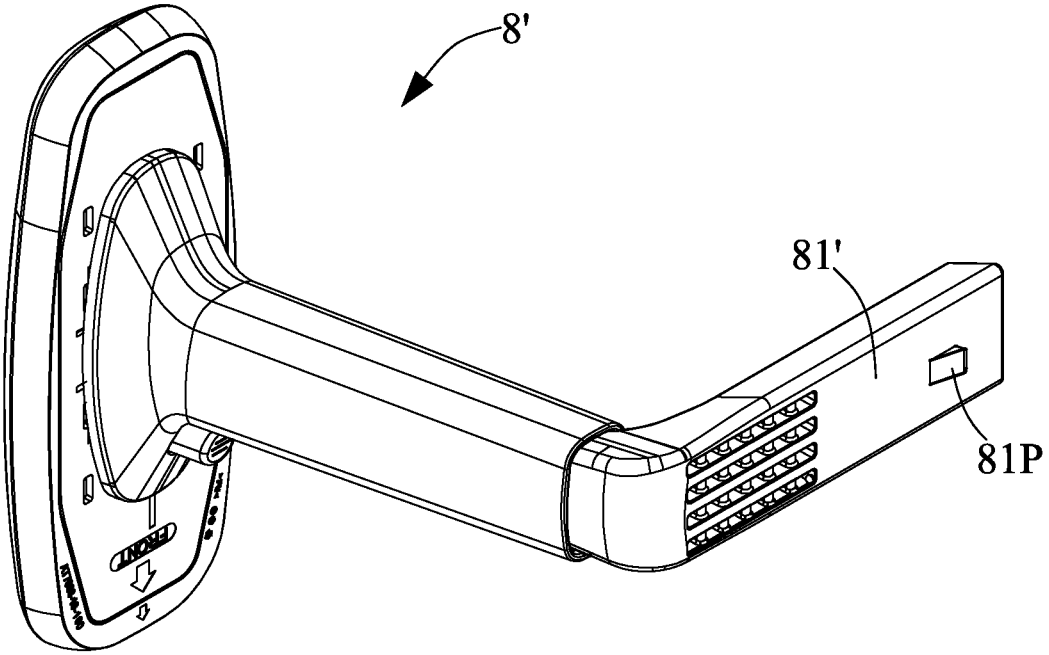
FIG. 3E is a schematic diagram of the armrest.
Figure 3F:
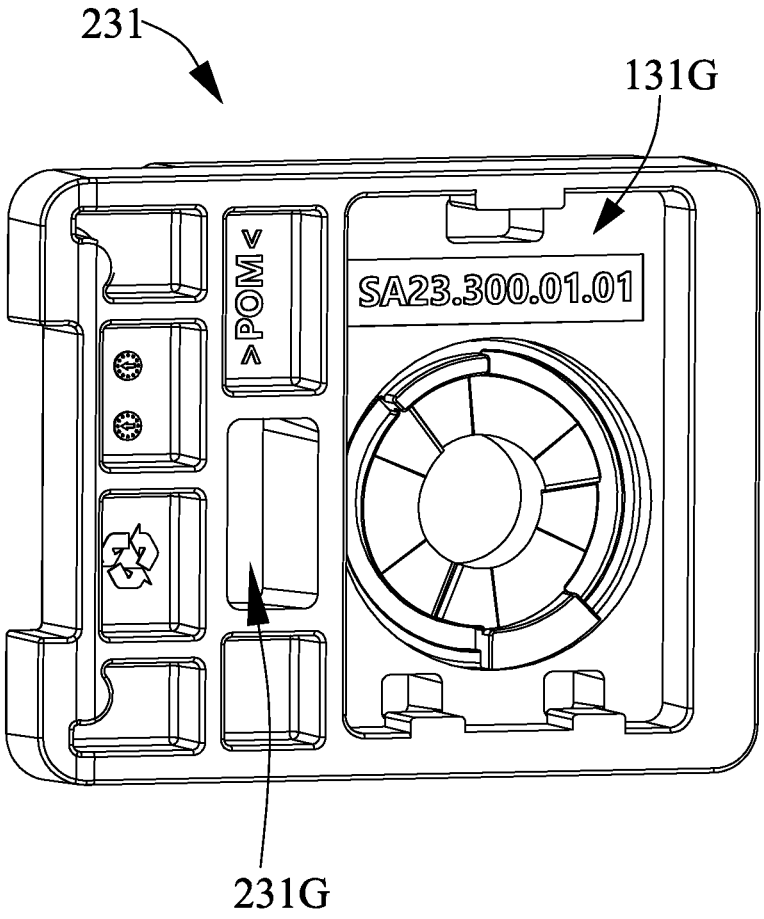
FIG. 3F is a schematic diagram of the mounting base.

In the embodiment, mounting base 131 features an anti-withdrawal part 131P, and crossbar 81 is equipped with a sliding groove 81G. However, in other implementations, the positions of anti-withdrawal part 131P and sliding groove 81G can be interchanged. In more detail, please refer to FIGS. 3E and 3F. Armrest 8' has an anti-withdrawal part 81P on crossbar 81', while mounting base 231 is also furnished with a retaining slot 231G, with both the retaining slot 231G and installation slot 131G situated on the same side of mounting base 231. Here, the anti-withdrawal part 81P of crossbar 81' interferes with one edge of retaining slot 231G. This arrangement similarly prevents crossbar 81' of armrest 8' from being withdrawn or dislodged from armrest slot 121.

Moreover, the operating element 133 is situated on the opposite side of mounting base 131 in relation to installation slot 131G, rendering it exposed beyond base 12 for effortless consumer manipulation. For instance, the operating element 133 may embody a rotating handle, which possesses a central hole 133C. Furthermore, the clamping element 132 is installed within the installation slot 131G, facing crossbar 81.

In this embodiment, the operating element 133 is a rotating handle. However, in other implementations, the operating element 133 can also be a rotary knob, lever, or other suitable mechanism. This allows for finer adjustments and control, facilitating more precise operation.

Figure 4A:
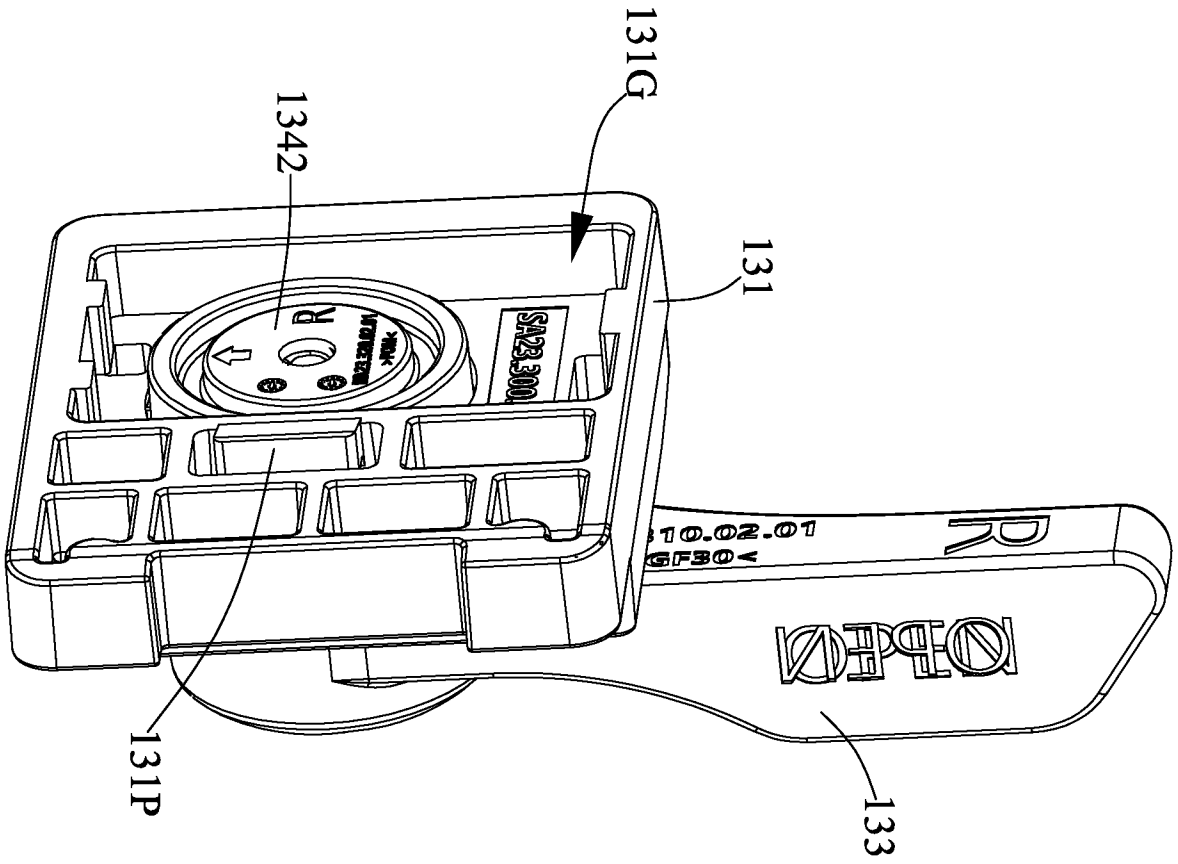
FIG. 4A is a schematic diagram of the pressing piece inside the mounting slot.
Figure 4B:
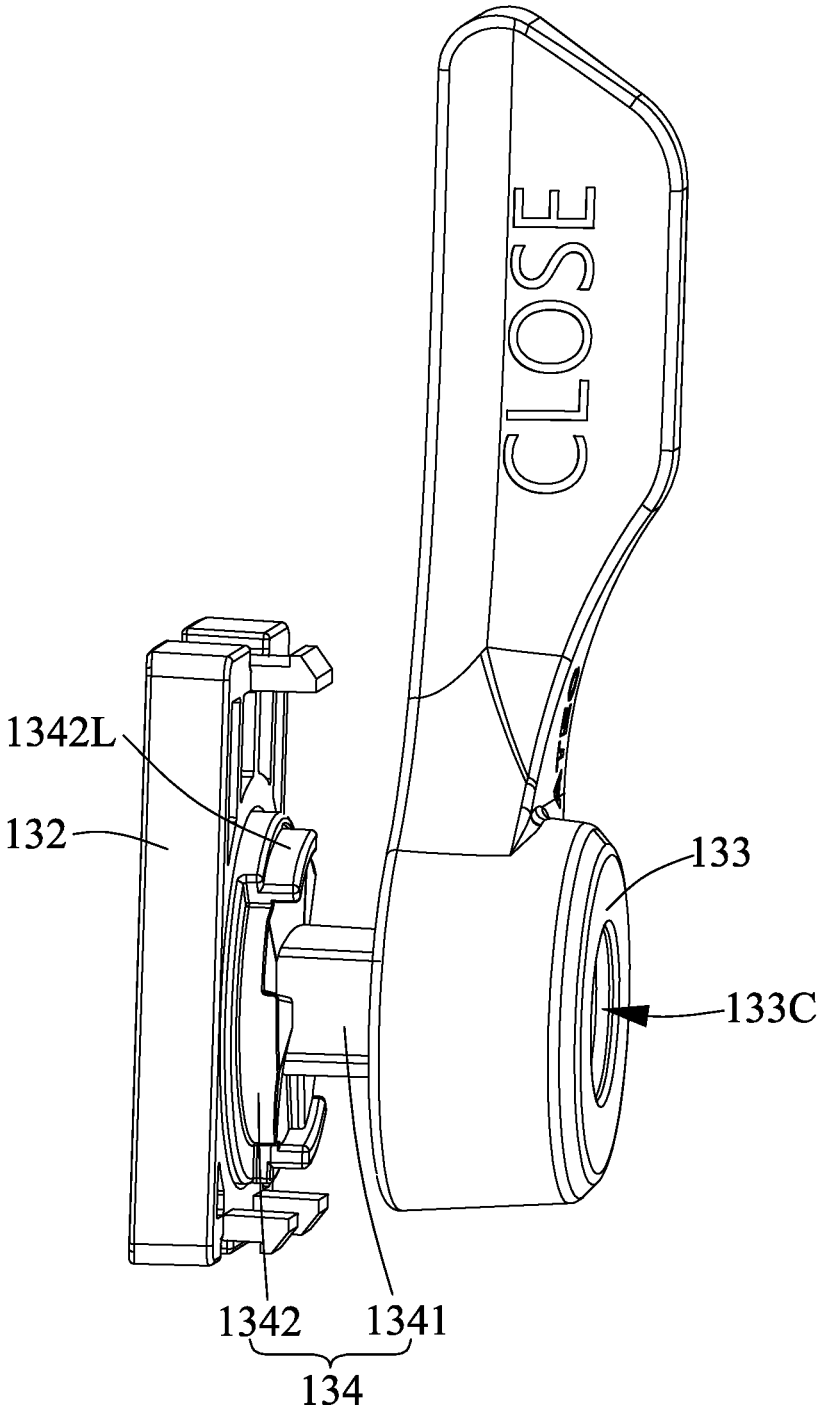
FIG. 4B is a schematic diagram of the positional relationship between the clamping element, the operating element, and the transmission element.
Figure 4C:
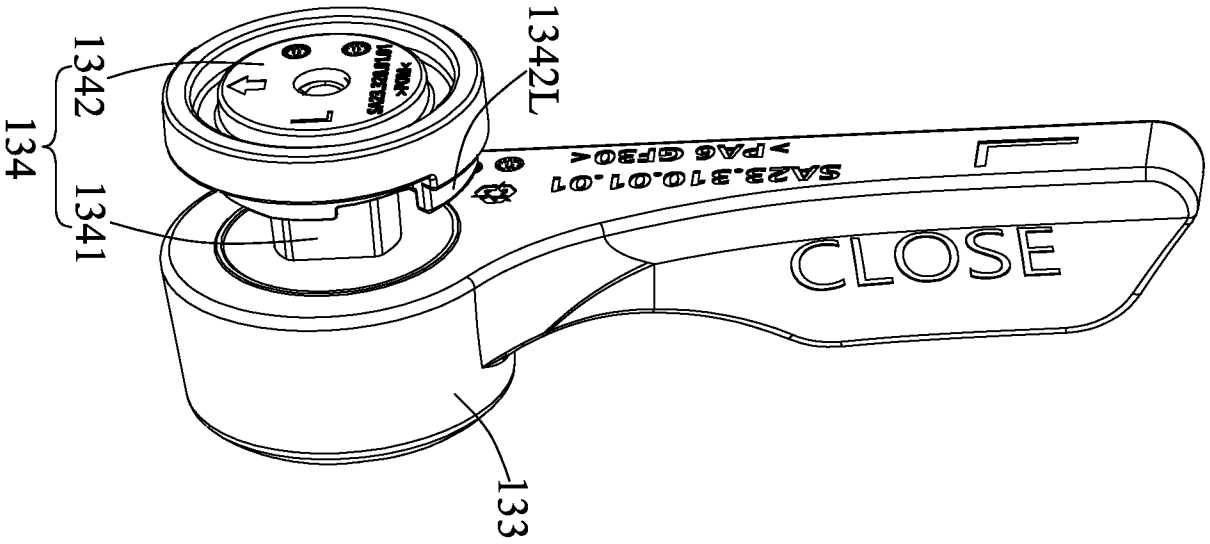
FIG. 4C is a schematic diagram of the transmission element connected to the operating element.
Figure 4D:
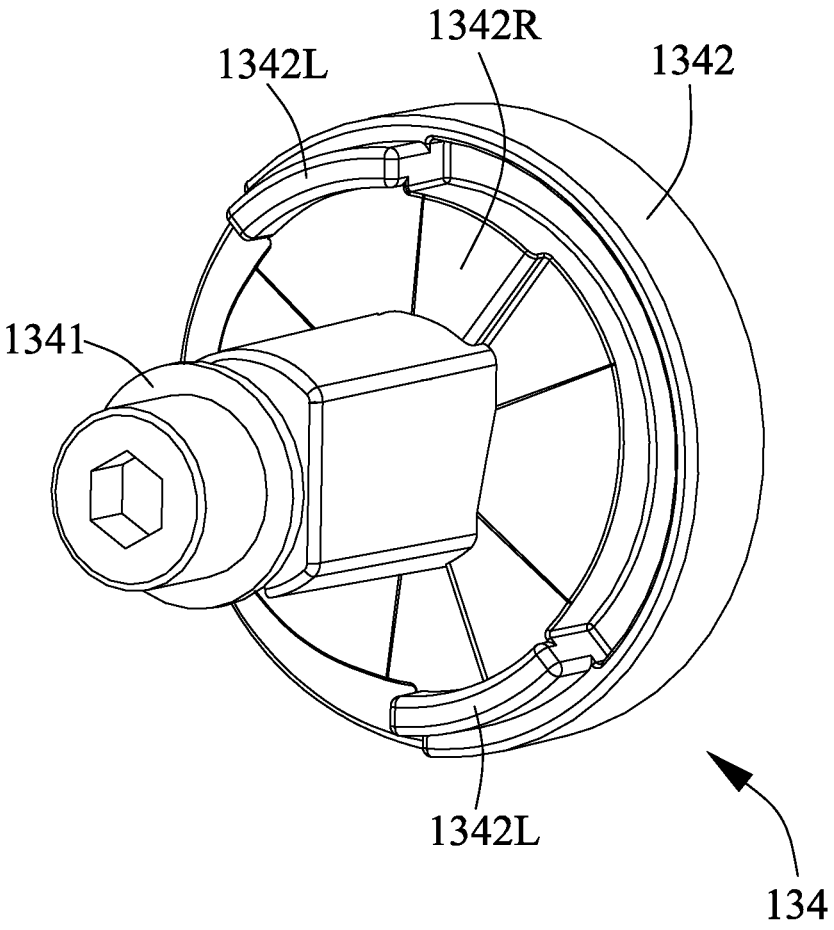
FIG. 4D is a schematic diagram of the transmission element.

Please refer to FIGS. 4A to 4D. FIG. 4A is a schematic illustration of the pressing member 1342 in the mounting slot 131G. FIG. 4B is a schematic illustration of the positional relationship among the clamping element 132, the operating element 133, and the transmission element 134. FIG. 4C is a schematic illustration of the transmission element 134 connected to the operating element 133. FIG. 4D is a schematic illustration of the transmission element 134.

In this embodiment, the transmission element 134 is connected between the clamping element 132 and the operating element 133, and the transmission element 134 includes a mounting shaft 1341 and a pressing member 1342. One end of the mounting shaft 1341 is mounted on the central hole 133C, while the pressing member 1342 is mounted on the other end of the mounting shaft 1341 and is in the mounting slot 131G. The mounting shaft 1341 has a foolproof structural design with arc surfaces on its upper and lower sides and flat surfaces on its left and right sides (refer to FIG. 4D). This structure helps to avoid errors caused by human factors, thus improving the product's reliability, stability, and safety.

Additionally, the pressing member 1342 presses against the clamping element 132 and includes a first toothed element 1342R and two first limiting members 1342L. The first toothed element 1342R is located on the side close to the mounting slot 131G. The two first limiting members 1342L are respectively located on both sides of the first toothed element 1342R and arranged in a parallel and symmetrical manner.

Furthermore, please refer again to FIG. 3C. The mounting slot 131G includes a second toothed element 131R, a through-hole 131H, and two second limiting members 1312. The second toothed element 131R is located at the bottom of the mounting slot 131G, and the through-hole 131H is at the center of the second toothed element 131R. The hole center of the through-hole 131H and the hole center of the central hole 133C are on the same straight line, and the mounting shaft 1341 passes through the through-hole 131H. In other words, the second toothed element 131R is between the pressing member 1342 and the operating element 133.

Moreover, the second toothed element 131R and the first toothed element 1342R are coupled together. Specifically, when the rotating handle is in the open state, the highest point of the first toothed element 1342R touches the lowest point of the second toothed element 131R, and the highest point of the second toothed element 131R also touches the lowest point of the first toothed element 1342R, forming a state where the two ratchets are coupled together. In this state, the position of the armrest 8 can be adjusted within a certain range, which is the lateral length of the groove 81G.

Furthermore, the two second limiting members 1312 of the mounting slot 131G are also located on both sides of the second toothed element 131R and arranged in a parallel and symmetrical manner. And when the second toothed element 131R is coupled with the first toothed element 1342R, the two first limiting members 1342L and the two second limiting members 1312 are arranged in an interlaced manner. Thus, through the first limiting members 1342L and the second limiting members 1312, the rotation range of the rotating handle, i.e., operating element 133, can be limited.

In this embodiment, the operating element 133 is adapted to drive the transmission element 134, causing the transmission element 134 to drive the clamping element 132 to move towards the crossbar 81 and press against the crossbar 81. Specifically, when the rotating handle is rotated in one direction (closed state), the mounting shaft 1341 will cause the first toothed element 1342R and the second toothed element 131R to have relative movement. The highest point of the first toothed element 1342R touches the highest point of the second toothed element 131R, causing the pressing piece 1342 to drive the clamping element 132 to move towards the crossbar 81. In this way, the clamping element 132 will firmly hold the crossbar 81, creating a friction force of a certain strength between the surface of the clamping element 132 and the surface of the crossbar 81, preventing the crossbar 81 from being easily moved by external forces. On the other hand, when the rotating handle is rotated back to its original position, the surface of the clamping element 132 will separate from the surface of the crossbar 81, allowing the user to adjust the crossbar 81 of the armrest 8 within a certain range.

In the embodiment, the surface of the clamping element 132 is flat. However, in other embodiment, the surface of the clamping element 132 could be wave-shaped, which can similarly generate a certain level of frictional force with the surface of the crossbar 81.

Figure 5A:
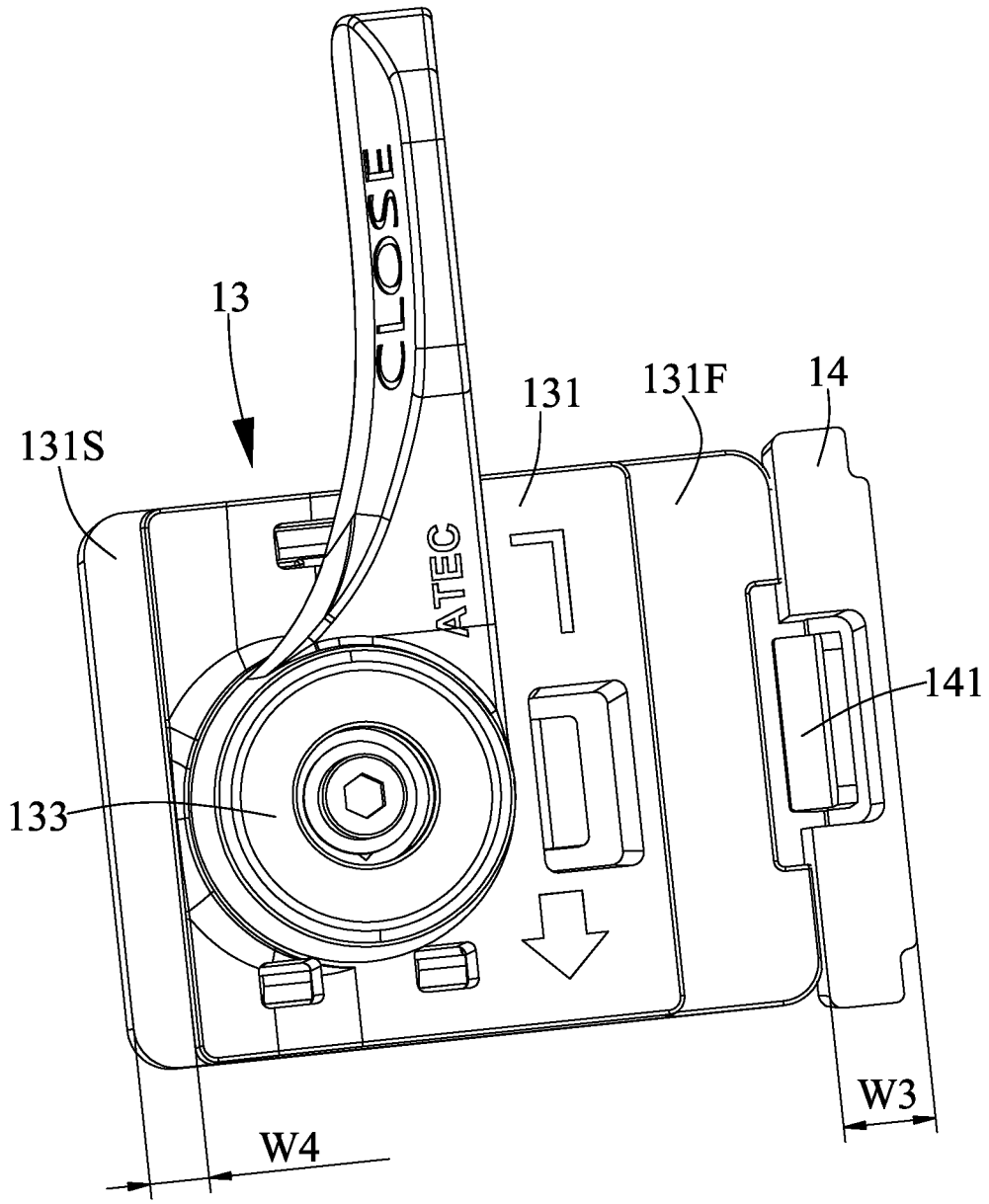
FIGS. 5A and 5B are schematic diagrams of the clamping device and the anti-skid plate at different angles.
Figure 5B:
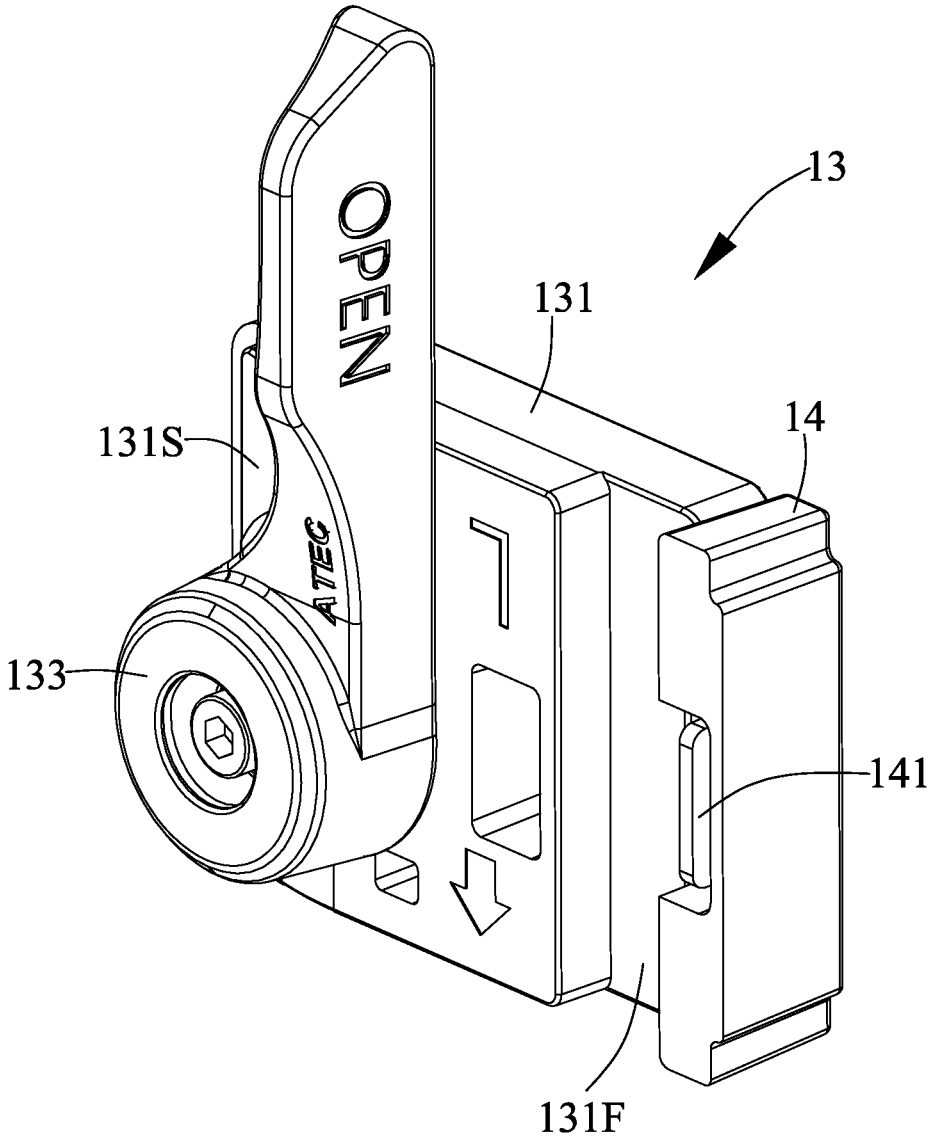
Figure 5C:
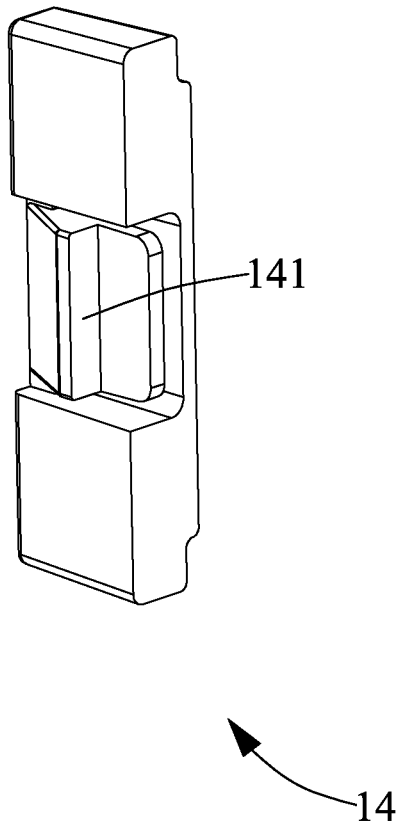
FIG. 5C is a schematic diagram of the anti-skid plate.
Figure 5D:
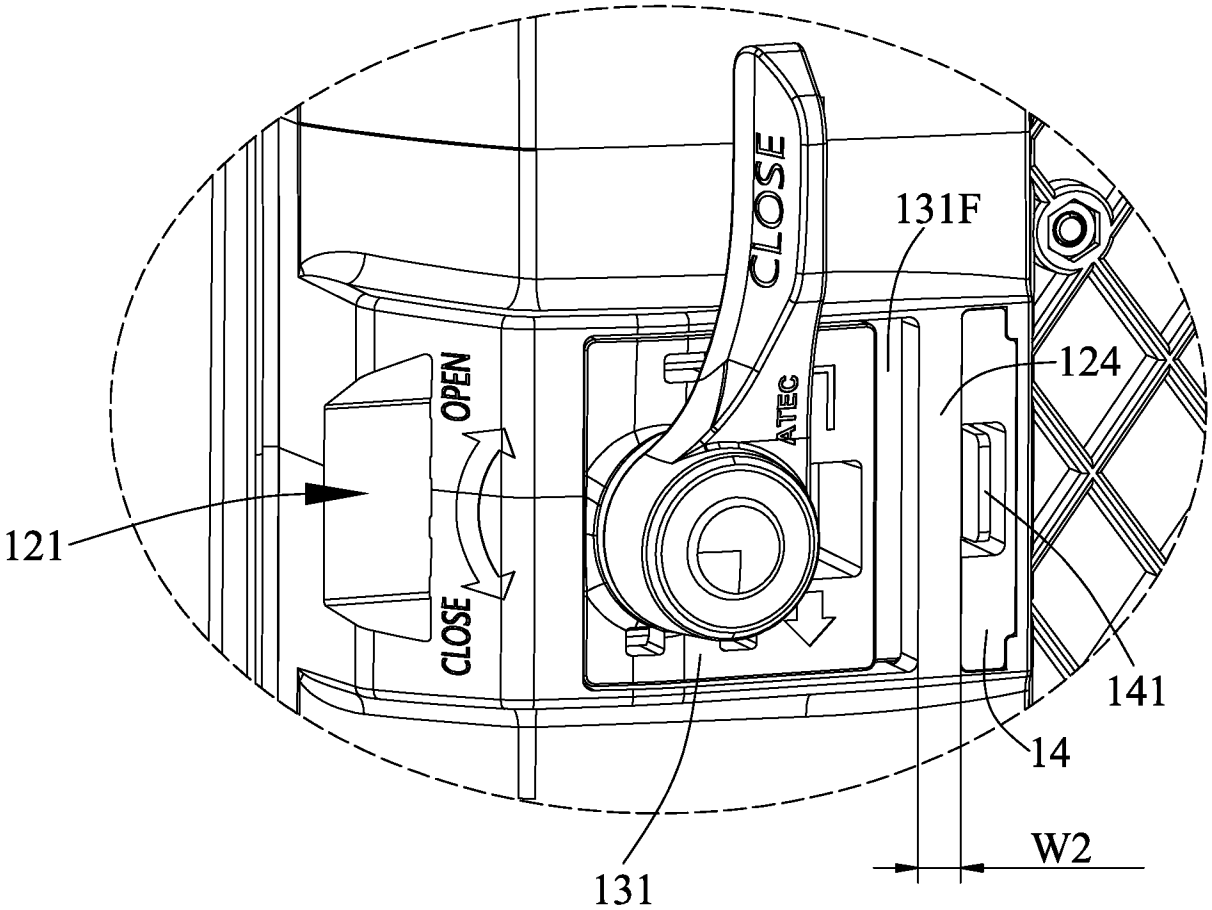
FIG. 5D is an enlarged view of the marked X portion in FIG. 1A.

Please refer to FIGS. 5A and 5B, which are schematic diagrams of the clamping device 13 and the anti-slip plate 14 at different angles, FIG. 5C is a schematic diagram of the anti-slip plate 14, and FIG. 5D is an enlarged view of the X portion indicated in FIG. 1A. The seat 10 also includes two anti-slip plates 14, each of which is mounted in an embedded hole 123. In this embodiment, the anti-slip plate 14 has an anti-pulling structure 141, which is interlocked with the supporting beam 124 of the base 12. Therefore, when the anti-slip plate 14 is placed in the embedded hole 123, the anti-pulling structure 141 can prevent the anti-slip plate 14 from falling out of the embedded hole 123. In addition, when an external force presses on the anti-pulling structure 141, the anti-pulling structure 141 can avoid the supporting beam 124 without being interlocked with the supporting beam 124, thereby removing the anti-slip plate 14 from the embedded hole 123.

Additionally, a first engaging edge 131F and a second engaging edge 131S are provided on the respective opposite sides of the mounting base 131. The mounting base 131 can be supported on the base 12 through the first engaging edge 131F and the second engaging edge 131S, and the first engaging edge 131F will abut against the anti-slip plate 14. Specifically, the width W1 of the first engaging edge 131F (please refer to FIG. 3A) is greater than the width W2 of the supporting beam 124 (please refer to FIG. 5D), and the width of the second engaging edge 131S interfering with the base 12 is less than the width W3 of the anti-slip plate 14 (please refer to FIG. 5A). In the embodiment, the width of the second engaging edge 131S interfering with the base 12 is the overall width W4 of the second engaging edge 131S (please refer to FIG. 5A). Therefore, when the anti-slip plate 14 is not yet placed in the embedded hole 123, the mounting base 131 can be installed in the mounting hole 122, and the first engaging edge 131F is supported on the lower surface of the supporting beam 124. Subsequently, the anti-slip plate 14 is placed in the embedded hole 123, and the side surface of the first engaging edge 131F abuts against the anti-slip plate 14.

Moreover, to remove the crossbar 81 of the armrest 8 from the base 12, the anti-slip plate 14 must first be removed from the embedded hole 123. Then, the mounting base 131 of the clamping device 13 is moved towards the direction of the embedded hole 123, allowing the clamping device 13 to be separated from the base 12. Afterward, since the groove 81G of the crossbar 81 is not blocked by the anti-detachment member 131P of the clamping device 13, the crossbar 81 of the armrest 8 can be pulled out of the armrest slot 121. Therefore, the seat 10 of this embodiment can easily assemble and disassemble the armrests 8 on both sides. This is advantageous for reducing the size of the outer packaging box of the seat 10 and significantly reducing the cost of transporting the product.

In summary, compared to traditional adjustable armrest office chairs, the seat 10 of this embodiment does not require the use of other components (e.g., screws) to secure the mounting base 131 when assembling the armrest 8 and the clamping device 13, making it convenient for users to assemble the armrests 8 on both sides by themselves while also reducing production costs.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A chair seat adapted for combining with two armrests, each of the armrests including a crossbar, the chair seat comprising:

a base, including at least one armrest slot and two mounting holes, the armrest slot adapted for inserting the crossbar, and the mounting holes being in communication with the armrest slot; and two clamping devices, each installed in one of the two mounting holes, each clamping device comprising:

a mounting base, installed and fixed in the mounting hole, and having a mounting slot on one side;

a clamping element, installed in the mounting slot and facing the crossbar;

an operating element, located on an opposite side of the mounting base relative to the mounting slot, the operating element being a rotating handle having a central hole; and a transmission element, connected between the clamping element and the operating element, the transmission element comprising a mounting shaft and a pressing member, one end of the mounting shaft being installed in the central hole of the rotating handle, and the pressing member being installed at the other end of the mounting shaft and located in the mounting slot, the pressing member having a first toothed element that presses against the clamping element;

wherein a second toothed element is provided at a bottom of the mounting slot, the second toothed element being engaged with the first toothed element; and wherein the operating element is adapted for driving the transmission element, causing the transmission element to move the clamping element towards the crossbar and clamp the crossbar.

2. The chair seat according to claim 1, wherein the pressing member further comprises two first limiting members, the two first limiting members being respectively located on both sides of the first toothed element and being arranged in a parallel and symmetrical manner; wherein the mounting slot further comprises two second limiting members, the two second limiting members being respectively located on both sides of the second toothed element and being arranged in a parallel and symmetrical manner.

3. The chair seat according to claim 1, wherein a sliding groove is provided on the crossbar of the armrest, and the mounting base further comprises an anti-detachment member, the anti-detachment member being adapted to interfere with one edge of the sliding groove to prevent the crossbar from being pulled out of the armrest slot.

4. The chair seat according to claim 1, wherein an anti-detachment member is provided on the crossbar of the armrest, and the mounting base further comprises a retaining slot, the anti-detachment member being adapted to interfere with one edge of the retaining slot to prevent the crossbar from being pulled out of the armrest slot.

5. The chair seat according to claim 1, further comprising two anti-slip plates, wherein an embedding hole is provided in a vicinity of each mounting hole of the base, the anti-slip plate is installed in the embedding hole, and a first engaging edge and a second engaging edge are respectively provided on opposite sides of the mounting base; the mounting base is supported on the base by the first engaging edge and the second engaging edge, and the first engaging edge is in contact with the anti-slip plate.

6. A clamping device suitable for installation on a mounting hole of a base of a chair seat, the clamping device comprising:

a mounting base, installed and fixed in the mounting hole, and the mounting base having an installation slot on one side;

a clamping element, installed in the installation slot;

a rotating handle, set on an opposite side of the mounting base relative to the installation slot, the rotating handle having a central hole; and a transmission element, comprising a mounting shaft and a pressing member, one end of the mounting shaft is installed in the central hole, and the pressing member is installed at the other end of the mounting shaft and located in the installation slot, the pressing member has a first toothed element on one side close to the installation slot, and the pressing member presses against the clamping element;

wherein a second toothed element is provided at a bottom of the installation slot, the second toothed element is coupled with the first toothed element; wherein when the rotating handle rotates in one direction, the mounting shaft drives the first toothed element and causes the first toothed element and the second toothed element to relatively move, thereby causing the pressing member to drive the clamping element to move up and down.

7. The clamping device according to claim 6, wherein the pressing member further includes two first limiting members, the two first limiting members are respectively located on both sides of the first toothed element and are parallel and symmetric; the installation slot further includes two second limiting members, the two second limiting members are respectively located on both sides of the second toothed element and are parallel and symmetric.

8. The clamping device according to claim 6, wherein the mounting base further includes an anti-extraction member, the anti-extraction member is on the side of the mounting base where the installation slot is located.

9. The clamping device according to claim 6, wherein the mounting base further includes a retaining slot, the retaining slot is on the side of the mounting base where the installation slot is located.

10. A chair seat adapted for combining with two armrests, each of the armrests including a crossbar, the chair seat comprising:

a base, comprising at least one armrest slot and two mounting holes, the armrest slot being adapted for the crossbar to be inserted, and the mounting holes being in communication with the armrest slot, an embedding hole being provided in the vicinity of each mounting hole of the base:

two clamping devices, respectively installed in the two mounting holes, each of the clamping devices comprising:

a mounting base, installed and fixed in the mounting hole, one side of the mounting base being provided with an installation slot, and a first engaging edge and a second engaging edge being respectively provided on opposite sides of the mounting base; and a clamping element, installed in the installation slot and facing the crossbar, the clamping element being adapted to clamp the crossbar; and two anti-slip plates, installed on a side of the mounting base opposite the installation slot, the anti-slip plates being installed in the embedding holes:

wherein through the first engaging edge and the second engaging edge, the mounting base is supported on the base, and the first engaging edge is in contact with the anti-slip plate.

11. A chair seat according to claim 10, wherein the embedding hole and the mounting hole are separated by a supporting beam, the first engaging edge is supported on the supporting beam, the width of the first engaging edge is greater than the width of the supporting beam, and the width of the second engaging edge in interference with the base is less than the width of the anti-slip plate.

12. The chair seat according to claim 11, wherein the anti-slip plate has an anti-pulling structure, and the anti-pulling structure is engaged with the supporting beam.

* * * * *